US011241883B2

(12) United States Patent
Nodsu

(10) Patent No.: US 11,241,883 B2
(45) Date of Patent: Feb. 8, 2022

(54) LIQUID DISCHARGE APPARATUS, LIQUID DISCHARGE METHOD, AND MEDIUM STORING PROGRAM EXECUTABLE BY LIQUID DISCHARGE APPARATUS

(71) Applicant: Brother Kogyo Kabushiki Kaisha, Nagoya (JP)

(72) Inventor: Tomohiro Nodsu, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 20 days.

(21) Appl. No.: 16/941,820

(22) Filed: Jul. 29, 2020

(65) Prior Publication Data

US 2021/0031528 A1 Feb. 4, 2021

(30) Foreign Application Priority Data

Aug. 1, 2019 (JP) ..... JP2019-142023

(51) Int. Cl.
*B41J 2/165* (2006.01)
*B41J 2/045* (2006.01)

(52) U.S. Cl.
CPC ..... *B41J 2/16526* (2013.01); *B41J 2/0451* (2013.01); *B41J 2/04581* (2013.01); *B41J 2/16579* (2013.01)

(58) Field of Classification Search
CPC ... B41J 2/16526; B41J 2/0451; B41J 2/16579
See application file for complete search history.

(56) References Cited

U.S. PATENT DOCUMENTS 7,497,547 B2 3/2009 Komatsu
2006/0157579 A1 7/2006 Komatsu

FOREIGN PATENT DOCUMENTS

JP 2006-175849 A 7/2006
JP 2015208973 A * 11/2015
JP 2016032899 A * 3/2016 ..... B41J 2/16535
JP 2018167484 A * 11/2018 ..... B41J 2/16505

* cited by examiner

*Primary Examiner* — Sharon Polk
(74) *Attorney, Agent, or Firm* — Banner & Witcoff, Ltd.

(57) ABSTRACT

There is provided a liquid discharge apparatus including a discharge head including nozzles and actuators; a liquid detecting sensor; and a controller. The controller is configured to: cause the actuators to perform a discharge operation; calculate a discharge amount of the liquid discharged from each of the nozzles; determine the discharge amount of the liquid; and cause a first actuator corresponding to a first nozzle, whose discharge amount is less than a first predetermined amount, and a second actuator corresponding to a second nozzle, whose discharge amount is not less than the first predetermined amount and less than a second predetermined amount, to perform a flushing, without causing a third actuator corresponding to a third nozzle, whose discharge amount is not less than the second predetermined amount, to perform the flushing.

12 Claims, 11 Drawing Sheets

LIQUID DISCHARGE APPARATUS, LIQUID DISCHARGE METHOD, AND MEDIUM STORING PROGRAM EXECUTABLE BY LIQUID DISCHARGE APPARATUS

CROSS REFERENCE TO RELATED APPLICATION

The present application claims priority from Japanese Patent Application No. 2019-142023, filed on Aug. 1, 2019, the disclosure of which is incorporated herein by reference in its entirety.

BACKGROUND

Field of the Invention

The present disclosure relates to a liquid discharge apparatus, a liquid discharge method and a medium storing a program executable by the liquid discharge apparatus.

Description of the Related Art

Japanese Patent Application Laid-open No. 2006-175849 describes a nozzle cleaning apparatus as a conventional liquid discharge apparatus. In the nozzle cleaning apparatus, in a case that a discharging test is performed and thus a nozzle which does not discharge an ink is found thereby, the nozzle cleaning apparatus executes a suction processing with respect to a nozzle array or nozzle row including the nozzle.

SUMMARY

In the nozzle cleaning apparatus described in Japanese Patent Application Laid-open No. 2006-175849, the suction processing is executed with respect to the nozzle array including the nozzle which does not discharge the ink, and thus the ink is discharged also from another nozzle which is included in the nozzle array and which discharges the ink normally. Accordingly, the ink is consumed wastefully or unnecessarily.

The present disclosure has been made to solve the above-described problem; and an object of the present disclosure is to provide a liquid discharge apparatus, a liquid discharge method and a medium storing a program executable by the liquid discharge apparatus which are capable of lowering any wasteful consumption of the liquid.

According to an aspect of the present disclosure, there is provided a liquid discharge apparatus including:

a discharge head including a plurality of nozzles and a plurality of actuators, each of the plurality of actuators being provided corresponding to each of the plurality of nozzles, and being configured to change a volume of a pressure chamber communicating with one of the plurality of nozzles;

a liquid detecting sensor; and a controller configured to:

cause each of the plurality of actuators to perform a discharge operation in which the volume of the pressure chamber is changed so that each of the plurality of nozzles discharges liquid;

calculate a discharge amount of the liquid discharged from each of the plurality of nozzles and detected by the liquid detecting sensor;

determine the discharge amount of the liquid is less than a first predetermined amount, not less than the first predetermined amount and less than a second predetermined amount, or not less than the second predetermined amount, the second predetermined amount being larger than the first predetermined amount; and cause a first actuator of the plurality of actuators corresponding to a first nozzle, whose discharge amount is less than the first predetermined amount, and a second actuator of the plurality of actuators corresponding to a second nozzle, whose discharge amount is not less than the first predetermined amount and less than the second predetermined amount, to perform a flushing in which the volume of the pressure chamber is changed, without causing a third actuator of the plurality of actuators corresponding to a third nozzle, whose discharge amount is not less than the second predetermined amount, to perform the flushing.

According to the above-described configuration, the flushing is performed with respect to the first nozzle, whose discharge amount is less than the first predetermined amount and the second nozzle, whose discharge amount is not less than the first predetermined amount and less than the second predetermined amount, whereas the flushing is not performed with respect to the third nozzle, whose discharge amount is not less than the second predetermined amount. With this, since the liquid is not wastefully discharged from the third nozzle, it is possible to reduce any wasteful consumption of the liquid.

According to the present disclosure, it is possible to provide the liquid discharge apparatus, the liquid discharge method and the medium storing the program executable by the liquid discharge apparatus each of which is capable of reducing any wasteful consumption of the liquid.

DESCRIPTION OF THE EMBODIMENTS

First Embodiment

<Configuration of Liquid Discharge Apparatus>

Figure 1:
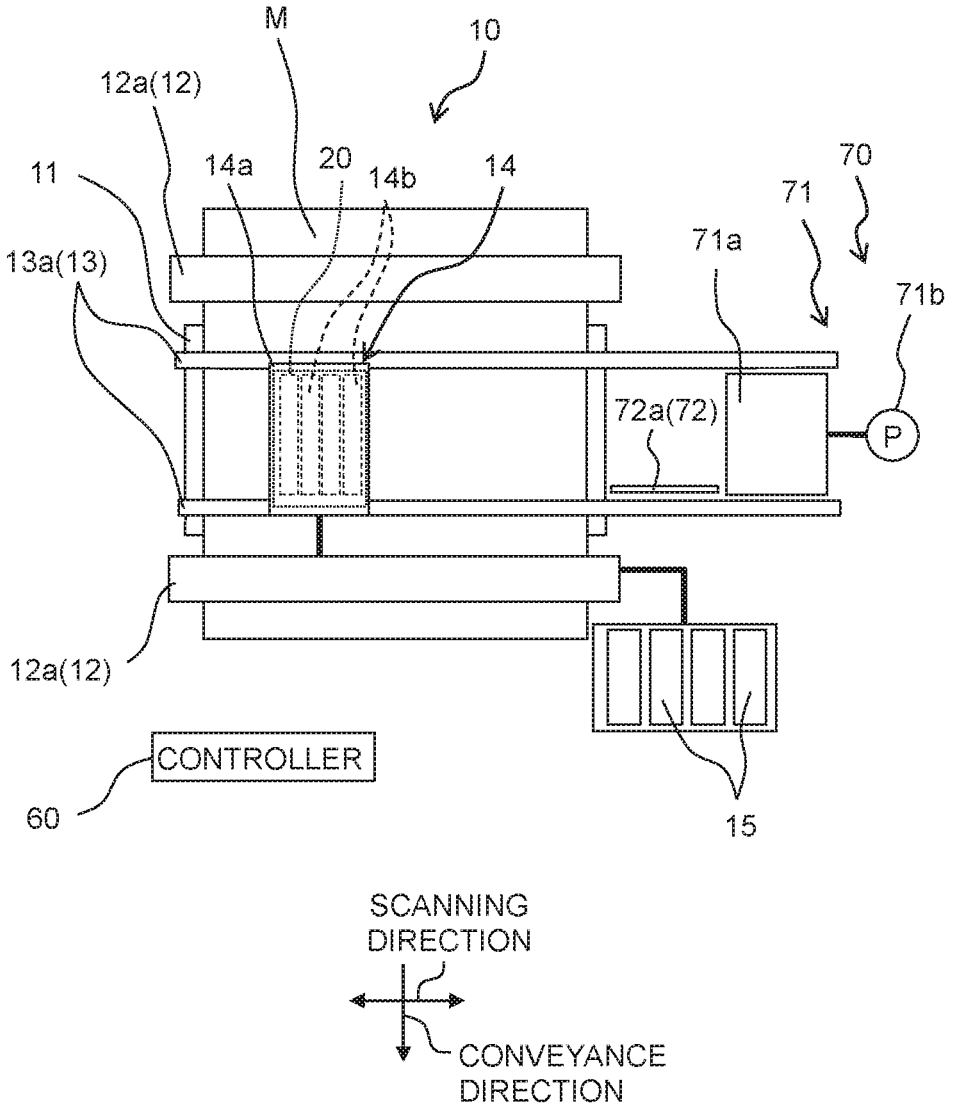
FIG. 1 is a schematic view depicting the overall configuration of a liquid discharge apparatus according to a first embodiment of the present disclosure.
Figure 2:
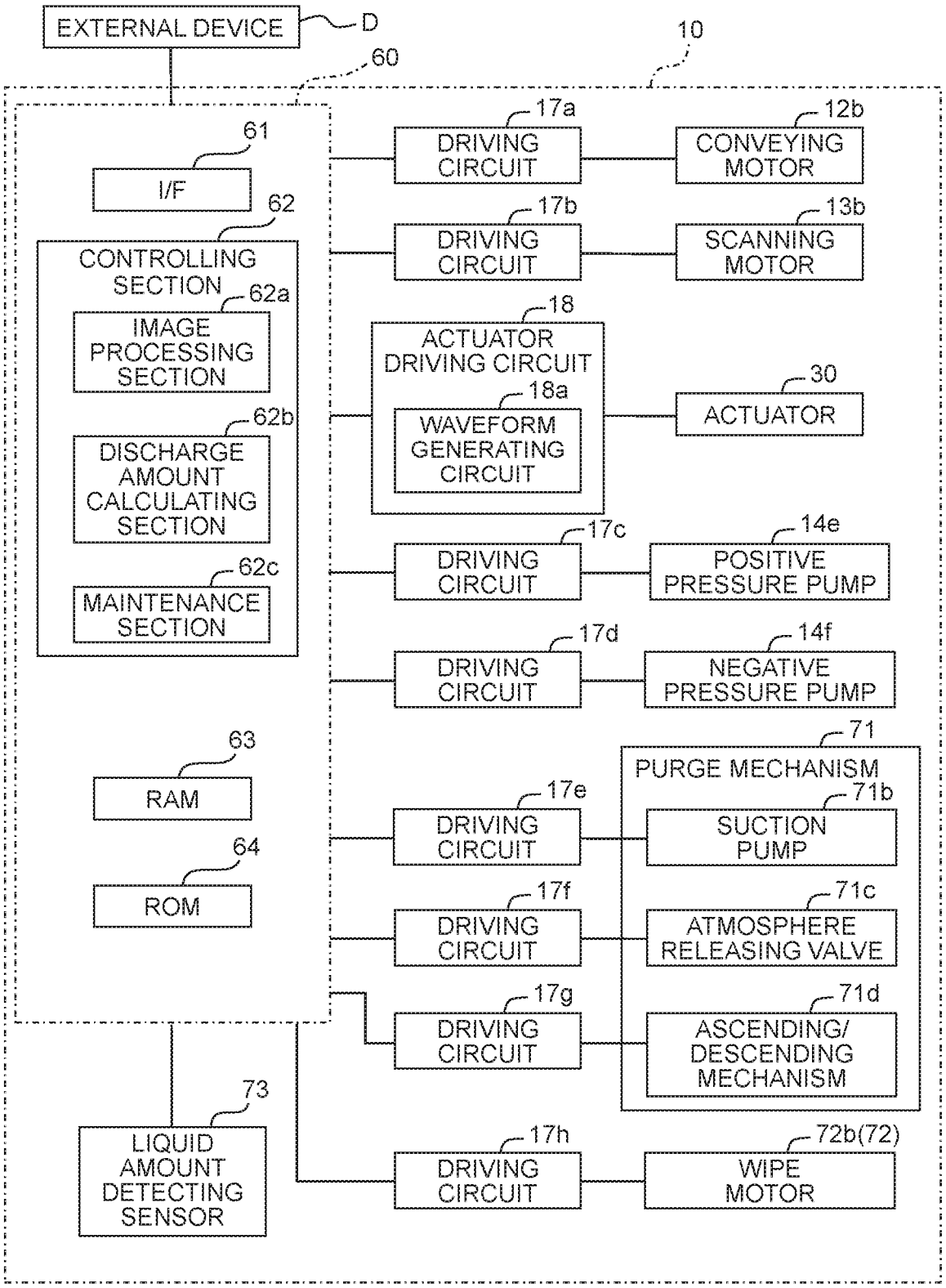
FIG. 2 is a block diagram depicting the functional configuration of the liquid discharge apparatus depicted in FIG. 1.

A liquid discharge apparatus (liquid discharging apparatus) 10 according to a first embodiment of the present disclosure is an apparatus configured to discharge a liquid, as depicted in FIGS. 1 and 2. In the following, although an example, in which the liquid discharge apparatus 10 is applied to an ink-jet printer configured to discharge a liquid such as an ink, etc., will be explained, the liquid discharge apparatus 10 is not limited to or restricted by this.

The liquid discharge apparatus 10 adopts the serial head system, and is provided with: a platen 11, a conveying mechanism 12, a scanning mechanism 13, a head unit 14, a storing tank 15, a controller 60 and a maintenance unit 70. Note that the liquid discharge apparatus 10 may adopt the line head system. Further, the maintenance unit 70 will be described in detail later on.

The head unit 14 has a carriage 14*a*, a discharge head 20 and one piece or a plurality of pieces (for example, 4 pieces) of sub tank 14*b*. The discharge head 20 and the four sub tanks 14*b* are arranged on or installed in the carriage 14*a*, and reciprocate in a scanning direction together with the carriage 14*a*.

The discharge head 20 has a channel forming body and a volume changing section. The channel forming body has a liquid channel which is formed in the inside of the channel forming body, and a plurality of nozzle holes 21*h* (FIG. 3) are open in the lower surface of the channel forming body. The volume changing section is driven to thereby change the volume of the liquid channel. In this situation, in each of the nozzle holes 21*h*, the meniscus is displaced and is vibrated, thereby discharging a droplet of the liquid (liquid droplet). Note that the specific of the discharge head 20 will be described later on.

The platen 11 is a member having a plate-like shape, and a recording medium M is placed or arranged on the upper surface of the platen 11. The platen 11 defines the distance between the recording medium M and the lower surface of the discharge head 20 which is arranged to face or to be opposite to the recording medium M. Note that although a side on the discharge head 20 with respect to the platen 11 is referred to as "upper side", and a side opposite to this side is referred to as "lower side", the arrangement of the liquid discharge apparatus 10 is not limited to this configuration.

The conveying mechanism 12 has, for example, two conveyance rollers 12*a* and a conveying motor (conveyance motor) 12*b*. The two conveyance rollers 12*a* sandwich the platen 11 therebetween in a conveyance direction, and are arranged to be parallel to each other. The conveying motor 12*b* is connected or linked to the conveyance rollers 12*a*. In a case that the conveying motor 12*b* is driven, the conveyance rollers 12*a* are rotated, thereby conveying the recording medium M on the platen 11 in the conveyance direction. Note that the conveyance direction is a direction crossing (for example, orthogonal to) the scanning direction.

The scanning mechanism 13 has two guide rails 13*a*, a scanning motor 13*b*, an endless belt, etc. The carriage 14*a* of the head unit 14 is supported by the two guide rails 13*a*, and is fixed to the endless belt. In a case that the scanning motor 13*b* is driven, the endless belt connected to the scanning motor 13*b* is thereby run. In this situation, the carriage 14*a* reciprocates (moves in a reciprocating manner) in the scanning direction, along the guide rails 13*a*.

The storing tank 15 is, for example, a detachable cartridge, and is provided on each kind of the liquid. For example, there are provided four storing tanks 15, and store black, yellow, cyan and magenta inks therein, respectively. Each of the storing tanks 15 is connected to one of the four sub tanks 14*b* corresponding thereto, via a tube, and supplies the liquid to the nozzle holes 12*h* via one of the four sub tanks 14*b*.

The controller 60 is connected to each of driving circuits driving the respective parts or components, etc., of the liquid discharge apparatus 10, and controls the driving of each of the respective parts, etc., by outputting control data to each of the driving circuits. For example, in a case that the controller 60 performs a printing processing, the controller 60 controls a driving circuit 17*a* to thereby drive the conveying motor 12*b*, controls a driving circuit 17*b* to thereby drive the scanning motor 13*b*, and controls an actuator driving circuit 18 to thereby drive an actuator 30 of the volume changing section.

By doing so, the controller 60 executes a pass processing including: a recording processing of causing liquid droplets, of which amount of the liquid are various, from the nozzle holes 21*h*, respectively, while moving the discharge head 20 in the scanning direction, to thereby form dots on the recording medium M; and a conveying processing of conveying the recording medium M in the conveyance direction. The printing processing progresses by alternately repeating the recording processing and the conveying processing, with the recording processing and the conveying processing made to be 1 (one) pass. Note that the details of the controller 60 will be described later on.

<Configuration of Discharge Head>

Figure 3:
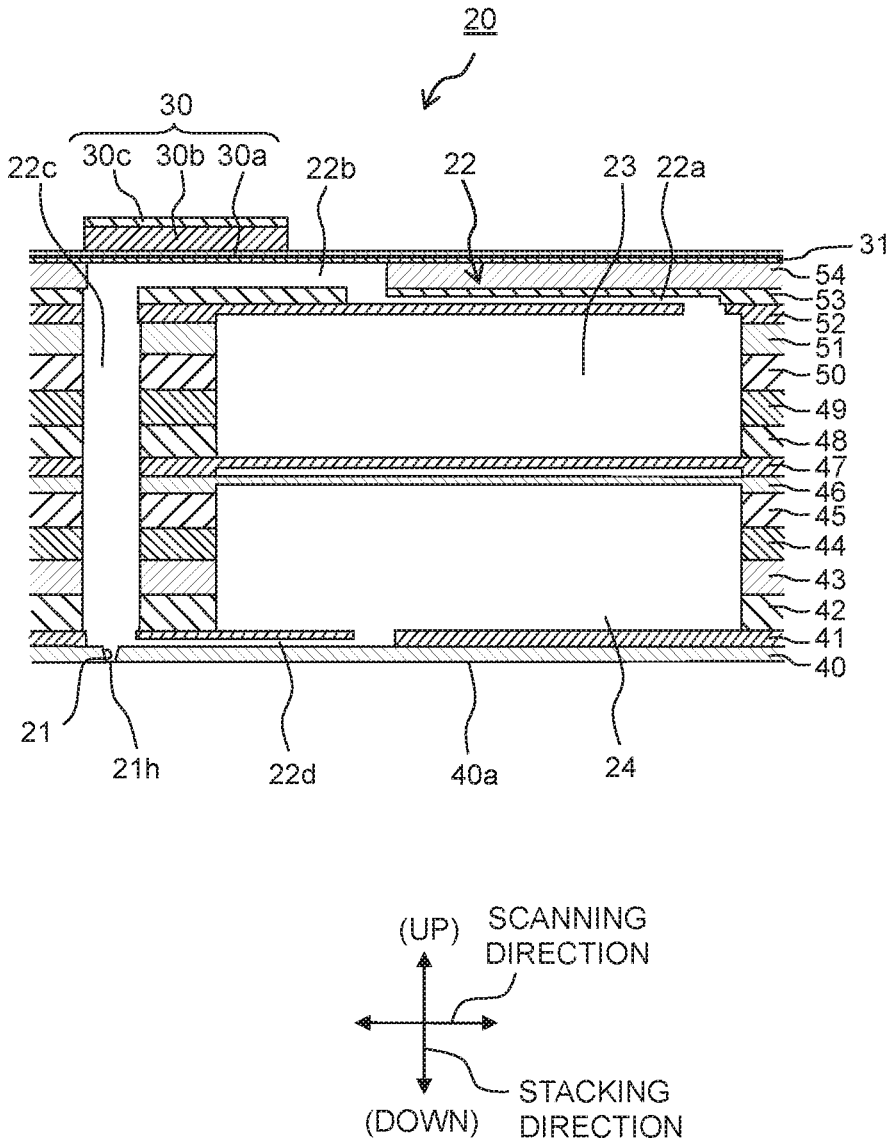
FIG. 3 is a cross-sectional view of a discharge head depicted in FIG. 1.
Figure 4:
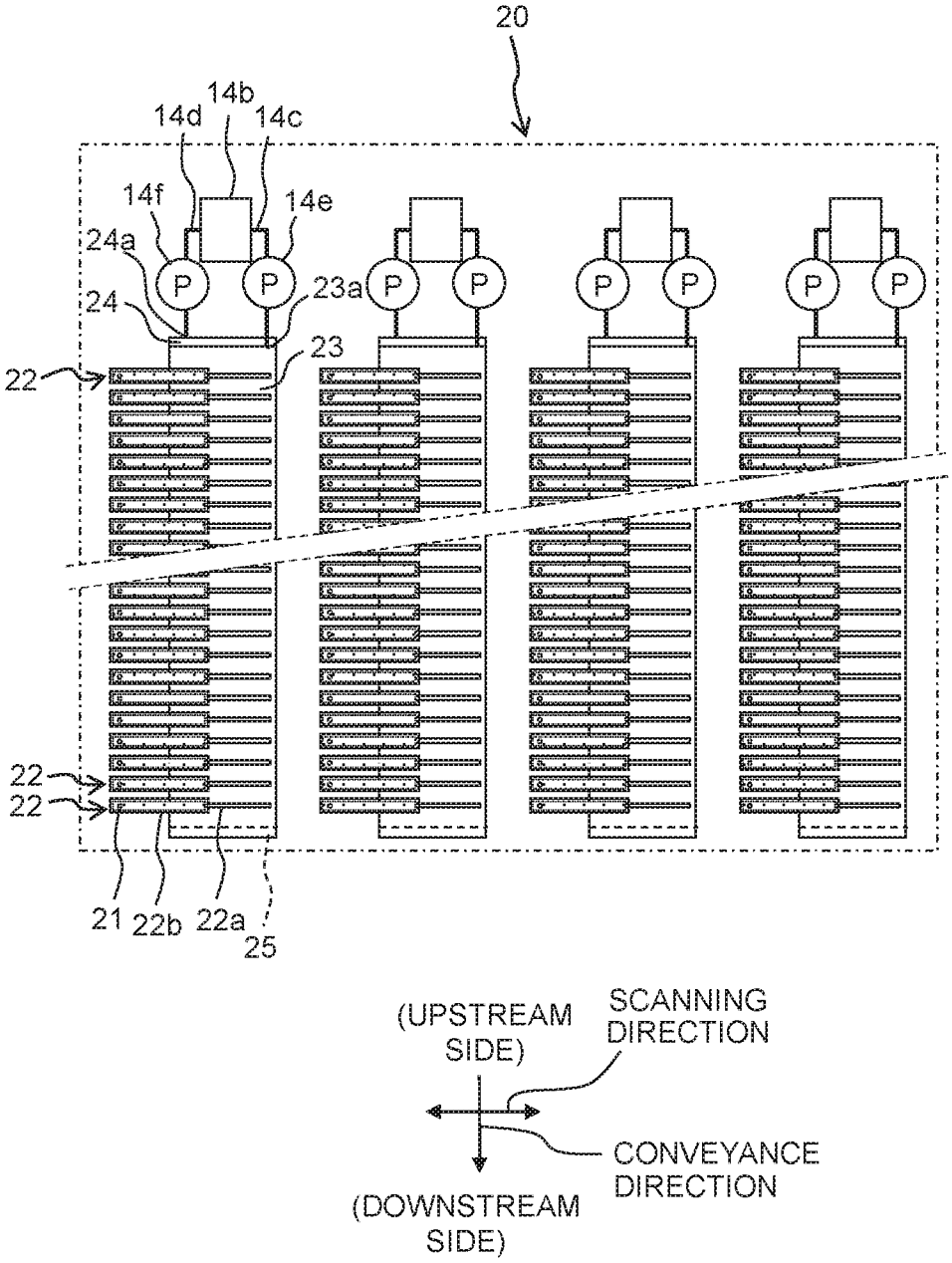
FIG. 4 is a view schematically depicting the relationship between the discharge head depicted in FIG. 1 and a sub tank.

As depicted in FIGS. 3 and 4, the discharge head 20 has the channel forming body and the volume changing section. The channel forming body is a stacked body of a plurality of plates. The plurality of plates include a nozzle plate 40 and first to fourteenth channel plates 41 to 54 which are stacked on top of one another in this order.

Holes and grooves which are various in size are formed in each of the plates. In the stacked body in which the respective plates are staked, the holes and grooves are combined to thereby form a plurality of liquid channels. The liquid channels include a plurality of nozzles 21, a plurality of individual channels 22 (channels), a supply manifold 23 and a return manifold 24.

Each of the plurality of nozzles 21 is formed by penetrating the nozzle plate 40 in a thickness direction thereof, and is open in a lower surface (discharge surface 40*a*) of the nozzle plate 40. Openings (nozzle holes 21*h*) of the plurality of nozzles 21 are aligned in the conveyance direction to thereby form a nozzle array or nozzle row, and a plurality of (for example, four) nozzle arrays are arranged side by side in the scanning direction.

The respective nozzle arrays correspond to liquids of mutually different colors (for example, black, yellow, cyan and magenta), respectively. Note that the plurality of nozzles 21 may be aligned in a direction crossing the conveyance direction. Further, the nozzle arrays may be arranged side by side in a direction crossing the scanning direction.

The supply manifold 23 extends in the conveyance direction, and has a supply port 23*a* provided on one end thereof. Further, the return manifold 24 extends in the conveyance direction, and has a return port 24*a* provided on one end thereof. The supply manifold 23 and the return manifold 24 are stacked on each other in a stacking direction, and are connected to each other at the other ends thereof, respectively, in the conveyance direction, by a communicating channel 25.

Each of the sub tanks 14*b* is connected to the supply port 23*a* by a supply channel 14*c* (supply path 14*c*) and is connected to the return port 24*a* by a return channel 14*d* (return path 14*d*). Further, the plurality of individual channels 22 are connected to the supply and return manifolds 23 and 24; each of the plurality of individual channels 22 reaches one of the plurality of nozzles 21 from the supply manifold 23, and reaches the return manifold 24 from one of the plurality of nozzles 21.

With this, the sub tank 14*b*, the supply channel 14*c*, the supply manifold 23, the communicating channel 25, the return manifold 24, the return channel 14*d* and the sub tank 14*b* construct a manifold circulation route in which the liquid is circulated in this order. Further, the sub tank 14*b*, the supply channel 14*c*, the supply manifold 23, the individual channels 22, the return manifold 24, the return channel 14*d* and the sub tank 14*b* construct a nozzle circulation route in which the liquid is circulated in this order.

The supply channel 14*c* is provided with a positive pressure pump 14*e* configured to supply the liquid from the sub tank 14*b* to the supply manifold 23. The return channel 14*d* is provided with a negative pressure pump 14*f* configured to supply the liquid from the return manifold 24 to the sub tank 14*b*. Note that either one, or both of, the positive pressure pump 14*e* and the negative pressure pump 14*f* may be provided on the manifold circulation route. Further, either one of the positive pressure pump 14*e* and the negative pressure pump 14*f* may be provided on the sub tank 14*b*.

The plurality of individual channels 22 connected to the supply manifold 23 and the return manifold 24 are communicated with the plurality of nozzles 21, respectively, constructing the nozzle array. In the present embodiment, each of the plurality of nozzles 21 constructing one nozzle array is connected to one piece of the supply manifold 23 and one piece of the return manifold 24 via one of the plurality of individual channels 22.

Each of the individual channels 22 has a supply-side throttle channel 22*a*, a pressure chamber 22*b*, a descender 22*c* and a return-side throttle channel 22*d* which are connected to one another in this order. Since the nozzle 21 is connected to the descender 22*c*, the pressure chamber 22*b* is communicated with the nozzle 21 via the descender 22*c*.

In such a liquid channel, the controller 60 (FIG. 2) controls driving circuits 17*c* and 17*d* (FIG. 2) to thereby drive at least one of the positive pressure pump 14*e* and the negative pressure pump 14*f*. With this, the liquid passes through the supply channel 14*c* from the sub tank 14*b*, and inflows into the supply manifold 23 via the supply port 23*a*. While the liquid is flowing through the supply manifold 23, the liquid branches into the plurality of individual channels 22 connected to the supply manifold 23. In each of the plurality of individual channels 22, the liquid flows in the supply-side throttle channel 22*a*, the pressure chamber 22*b* and the descender 22*c* in this order, inflows into the nozzle 21, and is discharged from the nozzle 21.

In this situation, the liquid which has not flowed into the nozzle 21 inflows into the return manifold 24 from the descender 22*c* via the return-side throttle channel 22*d*. Further, this liquid flows thorough the return manifold 24, flows from the return port 24*a* through the return channel 14*d* and returns to the sub tank 14*b*. In such a manner, the liquid flows in the nozzle circulation route.

Further, the liquid which has not flowed into the individual channel 22 from the supply manifold 23 inflows into the return manifold 24 from the supply manifold 23 via the communicating channel 25. Further, this liquid flows thorough the return manifold 24, flows from the return port 24*a* through the return channel 14*d* and returns to the sub tank 14*b*. In such a manner, the liquid flows in the manifold circulation route.

The volume changing section is arranged on the fourteenth channel plate 54, and includes an actuator 30 and a vibration plate 31. The pressure chamber 22*b* of the individual channel 22 is formed to penetrate through the fourteenth channel plate 54 in a thickness direction thereof. The vibration plate 31 is fixed on the fourteenth channel plate 54, and covers an opening of the pressure chamber 22*b*.

The actuator 30 is a piezoelectric element including a common electrode 30*a*, a piezoelectric layer (partial piezoelectric layer) 30*b* and an individual electrode 30*c*, and is arranged on the vibration plate 31. The common electrode 30*a* covers the entire surface of the vibration plate 31; the piezoelectric layer 30*b* is stacked on the common electrode 30*a*, and the individual electrode 30*c* is provided on the piezoelectric layer 30*b*, while corresponding to each of the pressure chambers 22*b*. By one piece of the individual electrode 30*c*, the common electrode 30*a* and the partial piezoelectric layer 30*b*, which is sandwiched by the common electrode 30*a* and one piece of the individual electrode 30*c*, construct one piece of the actuator 30.

The individual electrode 30*c* is connected to an actuator driving circuit 18, and a driving signal from the actuator driving circuit 18 is applied to the individual electrode 30*c*. In contrast, the common electrode 30*a* is always maintained at the ground potential.

In a state that the driving signal is not applied to individual electrode 30*c*, individual electrode 30*c* and the common electrode 30*a* have a same potential. In a case that the driving signal is applied to the individual electrode 30*c*, an active portion or active part (the partial piezoelectric layer 30*b* which is sandwiched between individual electrode 30*c* and the common electrode 30*a*) of the piezoelectric layer 30*b* contracts or shrinks in a planar direction together with the two electrodes which are individual electrode 30*a* and the common electrode 30*c*. The vibration plate 31 deforms in cooperation with the actuator 30, and changes the volume of the pressure chamber 22*b*. With this, the pressure is applied to the liquid of (in) the pressure chamber 22*b*. With this, the meniscus of the nozzle hole 21*h* is vibrated, and/or the liquid droplet is discharged from the nozzle hole 21*h*. Accordingly, the actuator 30 is provided corresponding to each of the plurality of nozzles 21, and changes the volume of one of the plurality of pressure chambers 22*b* communicating with each of the plurality of nozzles 21.

<Controller>

As depicted in FIG. 2, the controller 60 is provided with a network interface (I/F) 61, a controlling section 62 and a storing section (memory).

The I/F 61 receives a variety of kinds of data such as image data, etc., from an external device D including a computer, a camera, a network, a storage medium, etc. The image data indicates an image to be printed on the recording medium M, and has color information and gradation information.

The storing section is a memory accessible from the controlling section 62, and has a RAM 63 and a ROM 64. The RAM 63 stores a variety of kinds of information temporarily. An example of the variety of kinds of information is image data and data converted by the controlling section 62.

The RAM 64 stores a computer program and a control program for performing a variety kinds of data processings. Note that the computer program may be obtained from the external device D via the I/F 61; alternatively, the computer program may be stored in another storage medium.

The controlling section 62 has an arithmetic processing unit such as a processor (for example, a CPU), and controls the respective parts or elements by executing a computer program stored by the ROM 64. For example, the controlling section 62 causes the RAM 63 to store the variety of kinds of data, etc., received by the I/F 61.

Further, the controlling section 62 executes a computer program so as to exhibit the functions of an image processing section 62*a*, a discharge amount calculating section 62*b* and a maintenance section 62*c* (maintenance means). The controlling section 62 causes the RAM 63 to store a plurality of pieces of data obtained or processed by the image processing section 62*a*, the discharge amount calculating section 62*b* and the maintenance section 62*c*, respectively. Note that the discharge amount calculating section 62*b* and the maintenance section 62*c* will be described later on.

The image processing section 62*a* obtains the image data from the external device D via the I/F 61. In a case that this image data is data expressed by the RGB color space, the image processing section 62*a* converts this data to data expressed in the CMYK color space. The image data has image gradation values for the colors, respectively.

The image processing section 62*a* prepares, for example, dot data for each pixel from the gradation values of the image data. The dot data has dot position information and dot size information, and the dot data is, for example, a half tone. The dot size has: a dot of which size is small (small dot), a dot of which size is greater than the small dot (intermediate dot), a dot of which size is greater than the intermediate dot (large dot), and no dot (non-dot) in which any dot is not formed.

The image processing section 62*a* generates controlling data for controlling the respective driving circuits, based on the image data and the dot data, and outputs the generated controlling data to the respective driving circuits. For example, the driving circuit 17*a* drives the conveying motor 12*b* based on conveying motor controlling data from the image processing section 62*a*. Further, the driving circuit 17*b* controls the scanning motor 13*b* based on scanning motor controlling data from the image processing section 62*a*.

The actuator driving circuit 18 has a waveform generating circuit 18*a*, and drives the actuator 30 based on actuator controlling data from the image processing section 62*a*. The waveform generating circuit 18*a* generates a driving signal having a voltage waveform indicating the driving pattern of the actuator 30, and supplies the generated driving signal to the actuator 30. The actuator 30 executes an operation in accordance with the driving signal.

Here, the actuator controlling data defines driving of the actuator 30 for generating a dot, and defines, for example, an actuator 30 to be driven, a driving timing and a driving pattern. The actuator 30 to be driven is defined by the color of the dot, the position of the dot in the conveyance direction, the order of the control data supplied from the controlling section 62 to the actuator driving circuit 18, etc.

The driving timing is defined by the position of the dot in the scanning direction, the velocity of the discharge head 20 moving in the scanning direction, etc. The velocity of the discharge head 20 in the scanning direction is previously determined.

The driving pattern is defined by the size of the dot. For example, with respect to the intermediate dot, an intermediate droplet driving pattern is defined so that an intermediate droplet which is a liquid droplet having a predetermined volume (liquid amount) is discharged from the nozzle 21. Further, with respect to the small dot, a small droplet driving pattern is defined so that a small droplet, which has a smaller liquid amount than that of the intermediate droplet, is discharged from the nozzle 21. Furthermore, with respect to the large dot, a large droplet driving pattern is defined so that a large droplet, which has a greater liquid amount than that of the intermediate droplet, is discharged from the nozzle 21. Moreover, with respect to the no dot (non-dot), a non-driving pattern is defined so that the liquid is not discharged from the nozzle 21.

<Maintenance Unit>

As depicted in FIGS. 1 and 2, the maintenance unit 70 has a purge mechanism 71 configured to perform purge, a flushing mechanism configured to perform flushing, a wipe mechanism 72 configured to perform wipe, and a liquid detecting sensor 73.

The purge mechanism 71 is arranged at a maintenance area which is adjacent, in the scanning direction, to one side of the platen 11. Accordingly, the discharge head 20 is movable, by the scanning mechanism 13, from the other side of the platen 11, passing the platen 11, and up to the maintenance area on the one side of the platen 11. The purge mechanism 71 has a cap 71*a*, a suction pump 71*b*, an atmosphere releasing valve 71*c* and an ascending/descending mechanism 71*d*.

The ascending/descending mechanism 71*d* causes the cap 71*a* to ascend to a contact position at which the cap 71*a* makes contact with the discharge surface 40*a* of the discharge head 20, and causes the cap 71*a* which makes contact with the discharge surface 40*a* to descend to a separate position at which the cap 71*a* is separated and away from the discharge surface 40*a*. In such a manner, the ascending/descending mechanism 71*d* ascends and descends the cap 71*d* between the contact position and the separate position.

The cap 71*a* is formed, for example, of a rubber having elasticity, and has a box-like shape of which upper part is opened (which has an opening at the upper part thereof). The opening at the upper part faces the discharge surface 40*a* at the separate position. The cap 71*a* makes tight contact with the discharge surface 40*a* at the contact position so as to cover the nozzle holes 21*h* which are opened in the discharge surface 40*a*, thereby forming a tightly closed space between the cap 71*a* and the discharge surface 40*a*. A suction port is opened in the cap 71*a*, and a suction pipe is connected to the suction port.

The suction pump 17*b* is connected to the suction pipe, and the atmosphere releasing valve 71*c* is provided on the suction pipe. In a state that the atmosphere releasing valve 71*c* is closed, the tightly closed space between the cap 71*a* and the discharge surface 40*a* and the suction pump 71*b* are connected to each other in an airtight state. With this, in a case that suction is performed in the tightly closed space by the suction pump 71*b*, the inside of the cap 71*a* which is covered by the discharge surface 40*a* is depressurized. In a case that the liquid is discharged, by this purge, from the nozzle hole 21*h* into the inside of the cap 71*a*, the discharge characteristic is recovered. Further, in a state that the atmosphere releasing valve 71*c* is opened, the space between the cap 71*a* and the discharge surface 40*a* is released to the atmosphere, and the cap 71*a* is removed or detached from the discharge surface 40*a*.

The wipe mechanism 72 has a wiper 72*a* and a wipe motor 72*b*. The wipe motor 72*a* moves the wiper 72*a*, along the nozzle arrays, with respect to the discharge surface 40*a* in a state that the wiper 72*a* makes contact with the discharge surface 40*a*. With this, the wiper 72*a* is capable of wiping any liquid and a softened trace of liquid adhered to the discharge surface 40*a*.

The flushing mechanism is the volume changing section, and has the actuator 30 and the vibration plate 31. The actuator 30 is driven to thereby displace the vibration plate 31, which in turn changes the volume of the pressure chamber 22*b*. With this, the pressure is applied to the liquid in the pressure chamber 22*b*, thereby causing the liquid to be discharged from the nozzle 21. The discharged liquid may be recovered to the inside of the cap 71*a* of the purge mechanism 71, or may be recovered by a recovery container which is provided separately from the cap 71*a*.

The flushing includes flushing of the pull-strike system and flushing of the push-strike system. In the flushing of the push-strike system, the volume of the pressure chamber 22*b* is reduced from a predetermined volume; in the flushing of the pull-strike system, the volume of the pressure chamber 22*b* is increased from the predetermined volume and then is reduced to be not more than the predetermined volume. The change of the volume of the pressure chamber 22*b* depends on a driving signal which has a pulse waveform (pulse signal of voltage) and which is applied to the actuator 30. Accordingly, driving signals of waveforms which correspond to the pull-strike system and the push-strike system, respectively, are applied to the actuator 30.

Figure 5:
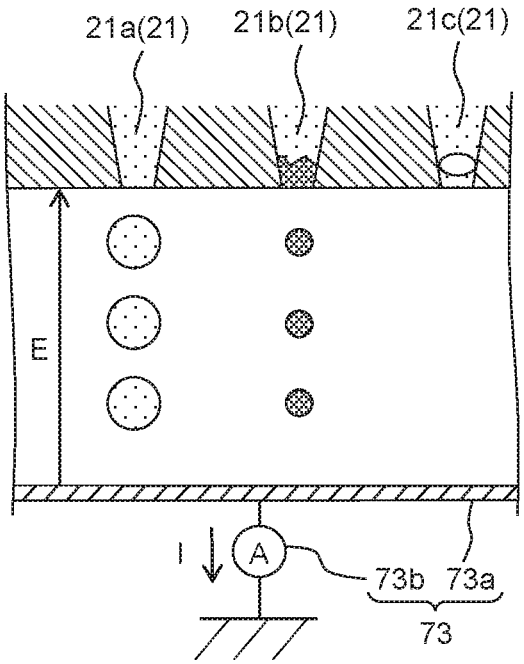
FIG. 5 is a view schematically depicting a liquid detecting sensor.

As depicted in FIG. 5, the liquid detecting sensor 73 has a detecting member 73*a* and a detecting section 73*b*, and is arranged, for example, in the maintenance area. The detecting member 73*a* is a linear-shaped stick or pole-like member having the conductivity and made of, for example, a metal. In the maintenance area, the detecting member 73*a* is arranged parallel to the discharge surface 40*a*, with a predetermined spacing distance from the discharge surface 40*a*. The detecting section 73*b* is electrically connected to the detecting member 73*a*, is configured to detect an electric current generated in the detecting member 73*a*, and outputs the detected electric current to the controlling section 62 (FIG. 2).

In a case that the voltage is applied to the detecting member 73*a* from an external power source, etc., an electric field E is generated between the detecting member 73*a* and the discharge surface 40*a*. Here, in a case that a liquid droplet is discharged from a nozzle hole 21*h* in the discharge surface 40*a*, the liquid droplet is electrically charged, and passes in the vicinity of the detecting member 73*a*. With this, an induced current is generated in the detecting member 73*a*, the detecting section 73*b* detects the induced current, and outputs a detecting single (of the induced current) to the controlling section 62. Since the induced current depends on the size of the liquid droplet, the liquid detecting sensor 73 is capable of detecting, based on the induced current, the amount of the liquid (liquid amount), which is discharged from each of the nozzle holes 21*h*, in one time of the discharge.

<Discharge Amount Calculating Section and Maintenance Section>

The maintenance section (maintenance unit) 62*c* executes a maintenance processing at a predetermined timing such as every predetermined time period, or at any timing indicated by a user through an operation of an input device such as key button, etc. The maintenance processing has an inspection processing of inspecting the discharge state of the nozzle(s) 21 and a recovery processing depending on a result of the inspection.

In the inspection processing, the discharge amount calculating section (discharge amount calculating unit) 62*b* calculates an amount of the liquid discharged from the nozzle 21 and detected by the liquid detecting sensor 73. Further, the maintenance section 62*c* determines the discharge state of the nozzle 21 based on the calculated amount (discharge amount) calculated by the discharge amount calculating section 62*b*.

Specifically, the maintenance section 62*c* causes the actuator 30 to perform a discharging operation, in which each of the plurality of nozzles 21 discharge liquid, for inspection (discharging operation for inspection processing). In the discharging operation for inspection, the maintenance section 62*b* outputs, to the actuator driving circuit 18, actuator controlling data for performing a discharging operation of discharging a liquid droplet form the nozzle 21 continuously for a predetermined number of times (for example, 10 times to 200 times). By doing so, the actuator driving circuit 18 supplies a discharge driving signal corresponding thereto, to the actuator 30.

With this, in a case that the liquid is discharged from the nozzle 21 corresponding to the actuator 30, the liquid detecting sensor 73 detects the liquid, and outputs a detection signal to the discharge amount calculating section 62*b*. The discharge amount calculating section 62*b* obtains the liquid amount of the liquid discharged by one time of the discharge from one nozzle 21, based on the detection signal from the liquid detecting sensor 73. The relationship between the induced current of the detection signal and the liquid amount are correlated to each other by an experiment, etc., in advance, and is stored in the ROM, etc.

The discharge amount calculating section 62*b* obtains a liquid amount (detected amount) detected by the liquid detecting sensor 73 per each of discharging operations which are continuously performed, and totals the detection amounts for a predetermined number of times of the discharging operations, and calculates the total amount as a discharge amount (calculated amount) of the nozzle 21.

The maintenance section 62*c* determines the discharge state of the nozzle 21 from the discharge amount calculated by the discharge amount calculating section 62*b*. For example, a nozzle 21*a* depicted in FIG. 5 discharges a liquid droplet in accordance with the discharging operation by the actuator 30. In this case, the discharge amount is not less than a second predetermined amount, and the maintenance section 62*c* determines this nozzle 21*a* to be a normal discharge nozzle 21*a* (third nozzle).

In this normal discharge nozzle 21*a*, a liquid droplet of which liquid amount is in accordance with the driving pattern of the actuator 30 is discharged every time the discharging operation is performed. For example, in the discharging operation of the intermediate droplet driving pattern, the intermediate droplet of the predetermined liquid amount is discharged from the normal discharge nozzle 21*a*. Accordingly, the second predetermined amount is determined or defined by the liquid amount in accordance with the driving pattern and the number of times of the discharging operation.

Further, for example, in a nozzle 21*b* depicted in FIG. 5, the liquid is dried from the nozzle hole 21*h* and the liquid inside the nozzle 21*b* becomes thick (viscosity of the liquid is increased). In such a case, the amount of the liquid discharged from the nozzle 21*b* becomes to be smaller than the liquid amount of the normal discharge nozzle 21*a*. In this case, the discharge amount from the nozzle 21*b* is not less than a first predetermined amount and less than the second predetermined amount, and thus the maintenance section 62*c* determines this nozzle 21*b* to be an unsatisfactory discharge nozzle 21*b* (second nozzle).

In this unsatisfactory discharge nozzle 21*b*, a liquid droplet of which liquid amount is smaller than the liquid amount in accordance with the driving pattern of the actuator 30 is discharged. For example, even in a case that the actuator 30 is caused to perform the discharging operation of the intermediate droplet driving pattern, the liquid amount of the liquid discharged from the unsatisfactory discharge nozzle 21*b* is smaller than the predetermined amount of the intermediate droplet. Accordingly, the first predetermined amount is determined to be smaller than the second predetermined amount and to be greater than 0 (zero).

Furthermore, in a nozzle 21*c* depicted in FIG. 5, an air bubble enters into and closes the nozzle 21*c*. In such a case, the liquid is not discharged or is hardly discharged from the nozzle 21*c*. Accordingly, the discharge amount from the nozzle 21*c* is less than the first predetermined amount, and thus the maintenance section 62*c* determines this nozzle 21*c* to be a non-discharge nozzle 21*c* (first nozzle).

With respect to such non-discharge nozzle 21*c* and unsatisfactory discharge nozzle 21*b*, the maintenance section 62*c* performs a recovery processing (maintenance step). The recovery processing includes flushing, and purge which is performed in a case that the nozzle(s) is/are not recovered by the flushing.

In the recovery processing by the flushing, the maintenance section 62*c* causes the actuators 30 to perform a flushing in which the volume of the pressure chamber 22*b* is changed so that the liquid is discharged from the non-discharge nozzle 21*c* and the unsatisfactory discharge nozzle 21*b*, whereas the maintenance section 62*c* does not cause the actuator 30, which corresponds to the normal discharge nozzle 21*a*, to perform the flushing.

The liquid amount (flushing amount) of the liquid to be discharged by the flushing may be predetermined. Namely, in one time of the flushing, one time or a plurality of times (for example, several hundreds of times) of the discharging operation is/are performed by the actuator 30. Here, the actuator 30 is driven by any one of the predetermined patterns which are: the small droplet driving pattern, the intermediate droplet driving pattern and the large droplet driving pattern.

Further, the discharging system of the flushing is at least one of the push-strike system (push-strike method) and the pull-strike system (pull-strike method). In the flushing of the push-strike system, the actuator 30 is driven so that the volume of the pressure chamber 22*b* is reduced from the predetermined volume. In the flushing of pull-strike system, the actuator 30 is driven so that the volume of the pressure chamber 22*b* is increased from the predetermined volume and then reduced to be not more than the predetermined volume. In such a manner, accompanying with the reduction of the volume of the pressure chamber 22*b*, the pressure is applied to the liquid in the pressure chamber 22*b* and the liquid in the nozzle 21 communicating with the pressure chamber 22*b*.

According to the pull-strike system, even in a case that the liquid in the nozzle 21 is thicken (increased in the viscosity) due to the drying of the liquid, it is possible to pull the thicken liquid into the nozzle circulation route, by once increasing the volume of the pressure chamber 22*b*, so that the thicken liquid is dispersed and the viscosity is lowered. With this, it is possible to improve any non-discharge or unsatisfactory discharge due to the increase in the viscosity.

Further, according to the push-strike system, the volume of the pressure chamber 22*b* is not increased. Accordingly, it is possible to lower any breakage of the meniscus which would be otherwise caused due to any air bubbles entering into the nozzle 21, and to reduce any pulling of air bubble into the nozzle 21. Accordingly, it is possible to improve any non-discharge or unsatisfactory discharge of the liquid due to the air bubble.

Here, it is allowable that the discharging system in a case that the flushing is performed is one of the push-strike system and the pull-strike system, and that the discharging system before the flushing is the other of the push-strike system and the pull-strike system. Namely, the discharging system at the time of the flushing may be changed from that in the recording processing and that in the inspection processing before the flushing.

With this, for example, there is such a case that any thicken liquid or any foreign matter such as an air bubble, etc., which could not be removed by the discharging operation of the pull-strike system, can be removed by using the push-strike system which is different from the pull-strike system, in some cases. Further, similarly, there is such a case that any foreign matter which could not be removed by the discharging operation of the push strike system, can be removed by using the pull-strike system, in some cases.

In a case that the discharge state of the non-discharge nozzle 21*c* is not improved even with the flushing, the maintenance section 62*b* performs a purge for the discharge head 20 including the non-discharge nozzle 21*c*. When performing the purge, the maintenance section 62*c* controls a driving circuit 17*e* to drive the suction pump 17*b*, controls a driving circuit 17*f* to drive the atmosphere releasing valve 71*c*, and controls a driving circuit 17*g* to drive the ascending/descending mechanism 71*d*.

The maintenance section 62*c* drives the scanning motor 13*b* so as to move the discharge head 20 in the scanning direction so that the discharge surface 40*a* faces the cap 71*a*. In this state, the maintenance section 62*c* controls the ascending/descending mechanism 71*d* so as to move the cap 71*a* from the separate position to the contact position. With this, the cap 71*a* makes tight contact with the lower surface of the discharge head 20 to cover the nozzle holes 21*h* of the discharge surface 40*a*.

Further, the maintenance section 62*c* drives the suction pump 71*b* so as to lower the pressure in the inside of the cap 71*a*, thereby forcibly discharge (exhaust) the liquid from the nozzle holes 21*h*. By this purge, it is possible to discharge (exhaust) any foreign matter entered into the nozzles 21, the individual channels 22, etc., in the discharge head 20, and to recover the discharge state of the nozzles 21.

Due to such flushing and purge, any liquid remains in the discharge surface 40*a*, in some cases. In view of such a situation, the maintenance section 62*c* performs wipe, following the flushing and the purge. Here, the maintenance section 62*c* drives the scanning motor 13*b* so as to move the discharge head 20 in the scanning direction so that the discharge surface 40*a* faces the wiper 72*a*. Then, the maintenance section 62*c* controls the driving circuit 17*h* to drive the wipe motor 72*b*, thereby moving the wiper 72*a* along the nozzle arrays in a state that the wiper 72*a* makes contact with the discharge surface 40*a*. With this, the liquid on the discharge surface 40*a* is removed.

Further, in a case that the discharge state of the non-discharge nozzle 21*c* is not improved even with the purge, the maintenance section 62*c* sets a complementary nozzle 21 with respect to the non-discharge nozzle 21*c*. This complementary nozzle 21 is a nozzle 21 which is included in the plurality of nozzles 21, which is different from the non-discharge nozzle 21*c*, and which discharge the liquid of the same color as that discharged from the non-discharge nozzle 21*c*. The maintenance section 62*c* may sets the complementary nozzle 21 in accordance with the non-discharge nozzle 21*c* based on a predetermined corresponding relationship between the nozzles 21, or may set the complementary nozzle 21 based on the image data.

For example, in a case that the image processing section 62*a* generates the actuator controlling data based on the dot data, the image processing section 62*a* make a setting so as not to drive the non-discharge nozzle 21*c*. Then, the maintenance section 62*c* specifies, as the complementary nozzle 21, a nozzle 21 which is included in other nozzles 21 discharging the liquid of the same color as that discharged from the non-discharge nozzle 21*c* and which is capable of forming a dot of the liquid discharged from the non-discharge nozzle 21*c*, based on a color and a position of the dot data. Then, the image processing section 62*a* allocates the actuator controlling data for the non-discharge nozzle 21*c* to the complementary nozzle 21. With this, the dot is complemented by the liquid from the complementary nozzle 21, it is possible to suppress any lowering in the image quality which would be otherwise occurred due to any lack of the dot due to the non-discharge.

<Liquid Discharging Method>

Figure 6A:
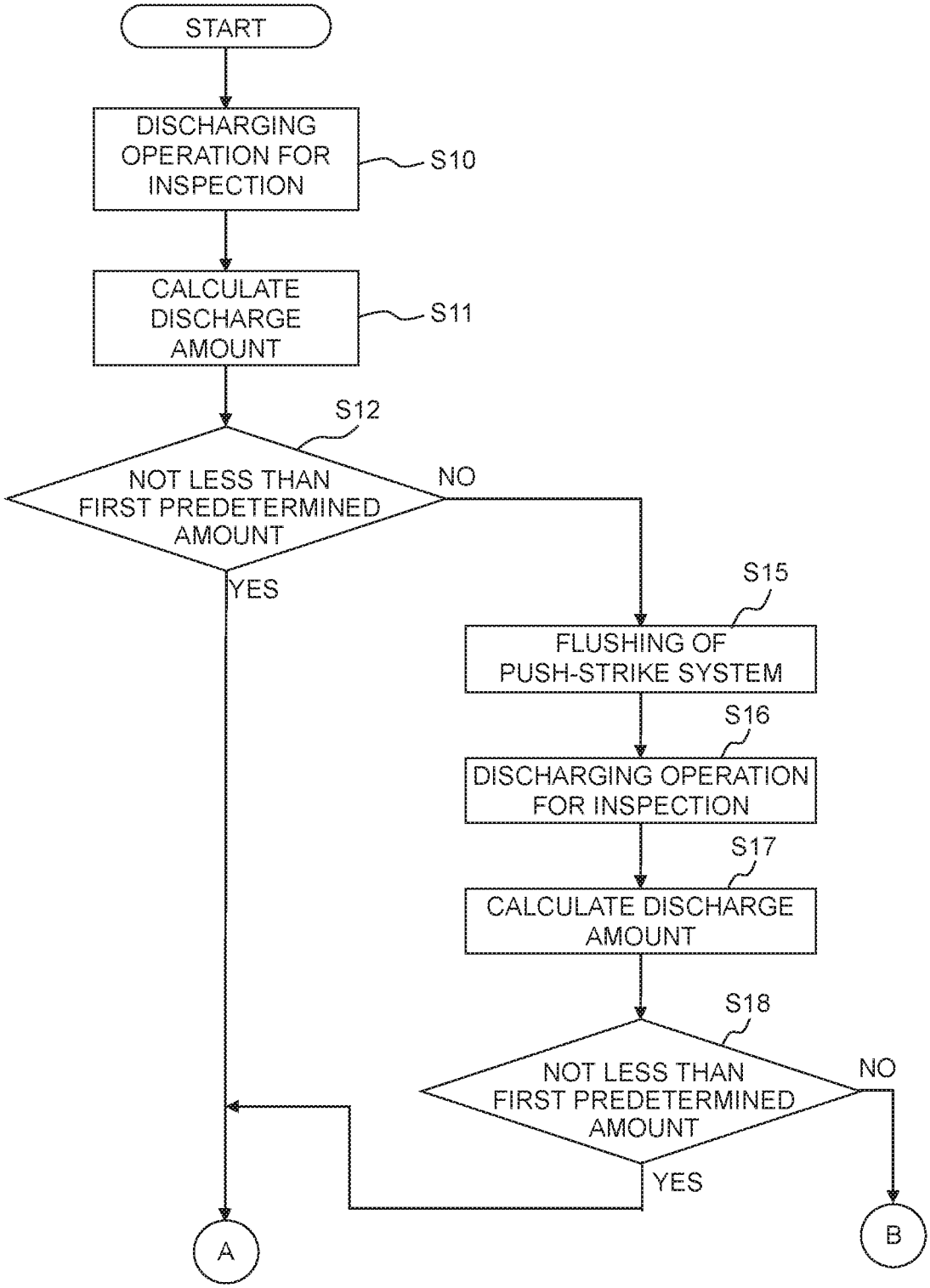
FIGS. 6A and 6B are flow charts depicting an example of a liquid discharge method by the liquid discharge apparatus depicted in FIG. 1.
Figure 6B:
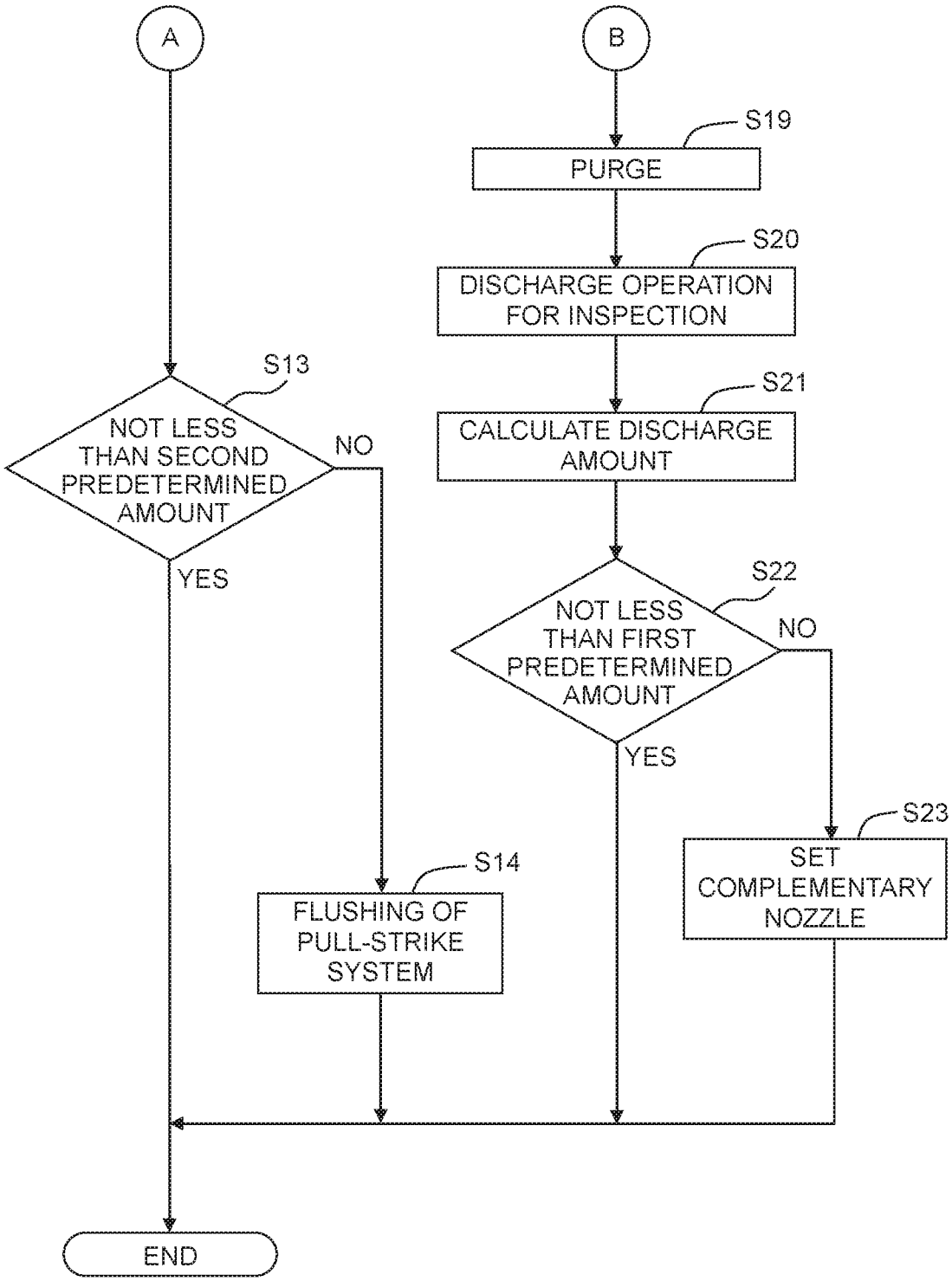

The liquid discharging method according to the present embodiment is performed by the controlling section 62 executing a computer program for operating the liquid discharge apparatus 10, in accordance with a flow chart depicted in FIGS. 6A and 6B.

The maintenance section 62*c* of the controlling section 62 causes the actuator 30 to perform a discharging operation for inspection (step S10). In this situation, the actuator 30 is driven continuously for a predetermined number of times, in the discharging system of the pull-strike system. In a case that the liquid is thereby discharged from a nozzle 21 corresponding to the actuator 30, the liquid detecting sensor 73 detects that the liquid has been discharged (liquid discharge), and outputs a detection signal to the discharge amount calculating section 62*b*.

The discharge amount calculating section 62*b* obtains the liquid amount, in accordance with the detection signal outputted from the liquid detecting sensor 73 within a predetermined period of time since the start of the driving of the actuator 30 for the inspection processing. The predetermined period of time is a time required for the discharging operation for inspection, and is a time required for the liquid to be discharged from the nozzle 21 in the case that the actuator 30 is driven continuously for the predetermined number of times.

The discharge amount calculating section 62*b* adds, for each of the nozzles 21, the discharged liquid amounts, and regards a total amount of the liquid amounts discharged within the predetermined period of time as a discharge amount (calculated amount) of each of the nozzles 21 (step S11). Then, the maintenance section 62*c* determines as to whether or not the discharge amount is not less than the first predetermined amount (step S12).

In step S12, in a case that the discharge amount is not less than the first predetermined amount (step S12: YES), then, the maintenance section 62*c* determines as to whether or not the discharge amount is not less than the second predetermined amount (step S13). The second predetermined amount is a value greater than the first predetermined amount.

In step S13, in a case that the discharge amount is not less than the second predetermined amount (step S13: YES), then the maintenance section 62*c* determines that the nozzle 21 is the normal discharge nozzle 21*a*. Accordingly, the maintenance section 62*c* ends the maintenance processing without performing the flushing for the normal discharge nozzle 21*a*.

On the other hand, in step S13, in a case that the discharge amount is in a range of not less than the first predetermined amount and less than the second predetermined amount (step S13: NO), the maintenance section 62*c* determines the nozzle 21 to be the unsatisfactory discharge nozzle 21*b*. In this case, there is a high possibility that the unsatisfactory discharge might be due to the increase in the viscosity, etc., the maintenance section 62*c* causes the actuator 30 to perform the flushing of the pull-strike system (step S14), and ends the maintenance processing.

In such a manner, the flushing is not performed with respect to the normal discharge nozzle 21*a*, but performed with respect to the unsatisfactory discharge nozzle 21*b*. Accordingly, since the liquid is not discharged wastefully from the normal discharge nozzle 21, it is possible to reduce any wasteful consumption of the liquid.

In step S12, in a case that the discharge amount is less than the first predetermined amount (step S12: NO), the maintenance section 62*c* determines the nozzle 21 to be the non-discharge nozzle 21*c*. In this case, there is a high possibility that the non-discharge might be due to the air bubble, etc., the maintenance section 62*c* causes the actuator 30 corresponding to the non-discharge nozzle 21*c* to perform the flushing of the push-strike system (step S15).

In such a manner, since the flushing is not performed with respect to the normal discharge nozzle 21*a*, but performed with respect to the non-discharge nozzle 21*c*, it is possible to reduce any wasteful consumption of the liquid. Further, with respect to the non-discharge nozzle 21*c* of which discharge state is quite unsatisfactory, the discharging system is changed from the discharging system for the inspection processing, thereby making it possible to easily improve the discharge state. Further, by the discharging system of the push-strike system, it is possible to lower the occurrence of the breakage of meniscus which would be otherwise caused by the air bubble.

Next, in order to confirm the change in the discharge state brought about by the flushing as described above, the maintenance section 62*c* causes the actuator 30 corresponding to the non-discharge nozzle 21*c* to perform the discharging operation for the inspection (step S16). With this, in a case that the liquid is discharged from the non-discharge nozzle 21*c*, the liquid detecting sensor 73 detects the discharged liquid, and the discharge amount calculating section 62*b* calculates a discharge amount (calculated amount) of each of the nozzles 21*c* in accordance with the detection signal from the liquid detecting sensor 73 (step S17). Then, the maintenance section 62*c* determines as to whether or not the discharge amount is not less than the first predetermined amount (step S18).

In step S18, in a case that the discharge amount is not less than the first predetermined amount (step S18: YES), the non-discharge nozzle 21*c* is improved by the flushing. Accordingly, the maintenance section 62*c* subsequently determines as to whether or not the discharge amount is not less than the second predetermined amount (step S13). The processings of step S13 and step S14, respectively, are similar to those described above.

On the other hand, in step S18, in a case that the discharge amount of the non-discharge nozzle 21*c* is less than the first predetermined amount (step S18: NO), the non-discharge nozzle 21*c* is not improved by the flushing. Accordingly, the maintenance section 62*c* further causes the purge mechanism 71 to perform the purge for the discharge head 20 (step S19).

Next, in order to confirm the change in the discharge state brought about by the purge as described above, the maintenance section 62*c* causes the actuator 30 corresponding to the non-discharge nozzle 21*c* to perform the discharging operation for the inspection (step S20). With this, in a case that the liquid is discharged from the non-discharge nozzle 21*c*, the discharge amount calculating section 62*b* calculates a discharge amount (calculated amount) of each of the nozzles 21*c* in accordance with the detection signals from the liquid detecting sensor 73 (step S21).

Then, the maintenance section 62*c* determines as to whether or not the discharge amount of the non-discharge nozzle 21*c* is not less than the first predetermined amount (step S22). In this situation, in a case that the discharge amount of the non-discharge nozzle 21*c* is not less than the first predetermined amount (step S22: YES), then the maintenance section 62*c* determines that the non-discharge nozzle 21*c* is improved by the purge, and ends the maintenance.

On the other hand, in a case that the discharge amount of the non-discharge nozzle 21*c* is less than the first predetermined amount (step S22: NO), then the maintenance section 62*c* determines that the discharge state of the non-discharge nozzle 21*c* is hard to be improved, and sets a complementary nozzle 21 which complements the non-discharge nozzle 21*c* (step S23). With this, it is possible to prevent any lacking of the dot due to the non-discharge, and to suppress any lowering in the image quality.

Note that in the flow chart of FIGS. 6A and 6B, although the pull-strike system is used for the discharging system of the flushing with respect to the unsatisfactory discharge nozzle 21*b*, it is allowable to use the push-strike system, or to use both the pull-strike system and the push-strike system. For example, in the processing of step S14, the pull-strike system and the push-strike system are alternately performed with respect to the unsatisfactory discharge nozzle 21*b*. With this, it is possible to improve the discharge state of the unsatisfactory discharge nozzle 21*b*.

Further, in the flow chart of FIGS. 6A and 6B, although the push-strike system is used for the discharging system of the flushing with respect to the non-discharge 21*c*, it is allowable to use the pull-strike system, or to use both the pull-strike system and the push-strike system. For example, in the processing of step S15, the pull-strike system and the push-strike system are alternately performed with respect to the non-discharge nozzle 21*c*. With this, it is possible to improve the discharge state of the non-discharge nozzle 21*c*.

<First Modification>

In a liquid discharge apparatus 10 according to a first modification, it is allowable that the maintenance section 62*c* drives the actuator 30, in a case that the flushing is performed, so that the liquid is discharged from the unsatisfactory discharge nozzle 21*b*, in an amount (liquid amount) according to the discharge amount (calculated amount) of the nozzle 21 calculated in step S11.

Figure 7A:
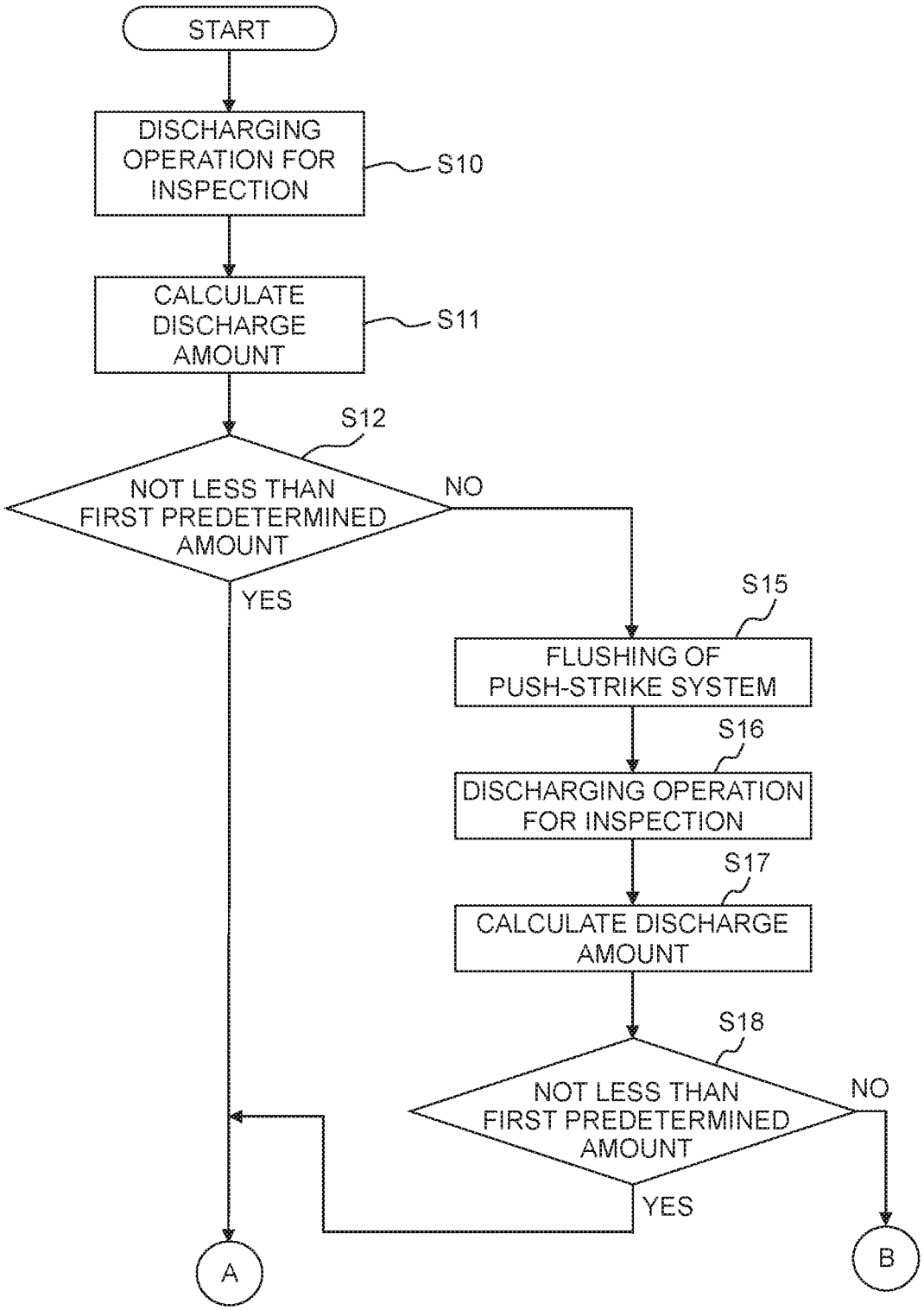
FIGS. 7A and 7B are flow charts depicting an example of a liquid discharge method by a liquid discharge apparatus according to a first modification of the present disclosure.
Figure 7B:
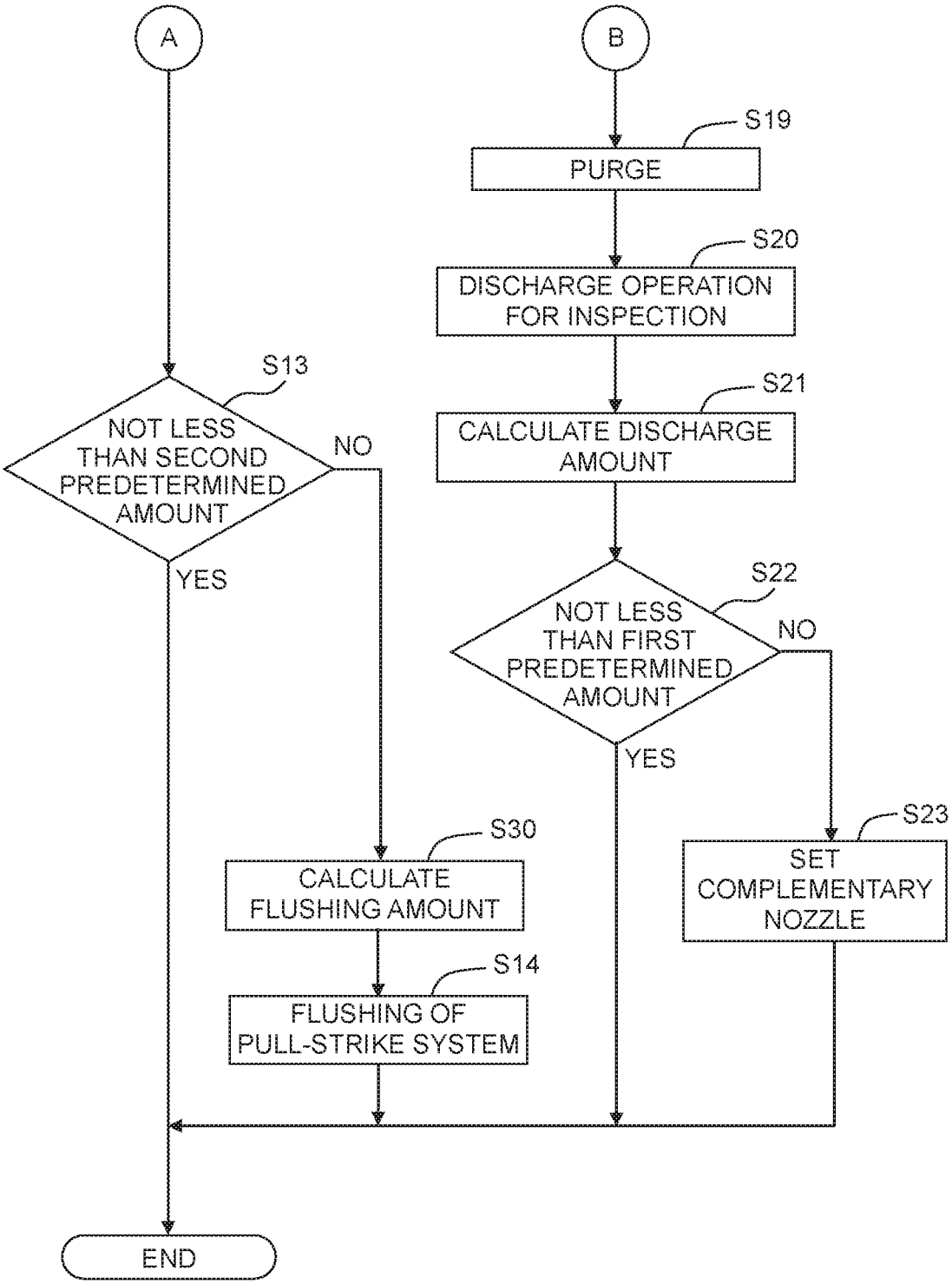

A liquid discharging method according to the first modification is, for example, performed by the controlling section 62 executing a computer program for operating the liquid discharge apparatus 10, in accordance with a flow chart depicted in FIGS. 7A and 7B. The processing of step S30 of FIG. 7B is executed between the processing of step S13 and the processing of step S14 of FIG. 6B. Since the processings of steps S10 to S23 of FIGS. 7A and 7B are same as or similar to those of FIGS. 6A and 6B, any explanation therefor will be omitted.

In step S13, in a case that the discharge amount (calculated amount) of the nozzle 21 is in a range of not less than the first predetermined amount and less than the second predetermined amount (step S13: NO), the maintenance section 62*c* calculates a flushing amount according to the discharge amount of the unsatisfactory discharge nozzle 21 (step S30). Note that the discharge amount and the flushing amount are correlated to or are made to correspond to each other in advance as the relationship therebetween, and the relationship is stored in the ROM, etc.

Namely, the liquid amount (flushing amount) to be discharged from a certain nozzle 21 by the flushing corresponds to the volume change amount, of a certain pressure chamber 22*b*, to be changed in the flushing by a certain actuator 30 corresponding to the certain nozzle 21. The volume change amount is adjusted by at least one of a number of times of driving of the actuator 30 and a driving pattern of the actuator 30 in the flushing. Accordingly, as the discharge amount is smaller, the discharge state is more unsatisfactory, and thus the maintenance section 62*c* increases the number of times of driving of the actuator 30 to thereby increase the flushing amount.

Further, the driving pattern of the actuator 30 depends on the volume change amount of the pressure chamber 22*b* by the actuator 30. The volume change amount becomes greater in an ascending order of the small droplet driving pattern, the intermediate droplet driving pattern and the large droplet driving pattern. Accordingly, as the discharge amount of the unsatisfactory discharge nozzle 21*b* is smaller, the driving pattern is selected so that the volume change amount becomes greater, and thus making the flushing amount to be greater.

With this, the flushing amount and the liquid amount to be discharged by the flushing are adjusted based on a degree of unsatisfactory discharge. Accordingly, it is possible to improve the unsatisfactory discharge while lowering any wasteful consumption of the liquid.

Second Embodiment

In a liquid discharge apparatus 10 according to a second embodiment of the present disclosure, the discharge amount calculating section 62*b* calculates amounts of the liquid discharged, by the flushing, from the non-discharge nozzle 21*c* and the unsatisfactory discharge nozzle 21*b*, respectively. Other than this, the configuration, action and effects, etc., of the liquid discharge apparatus 10 according to the second embodiment are same as or similar to those of the first embodiment, and thus, any explanation therefor will be omitted.

Figure 8A:
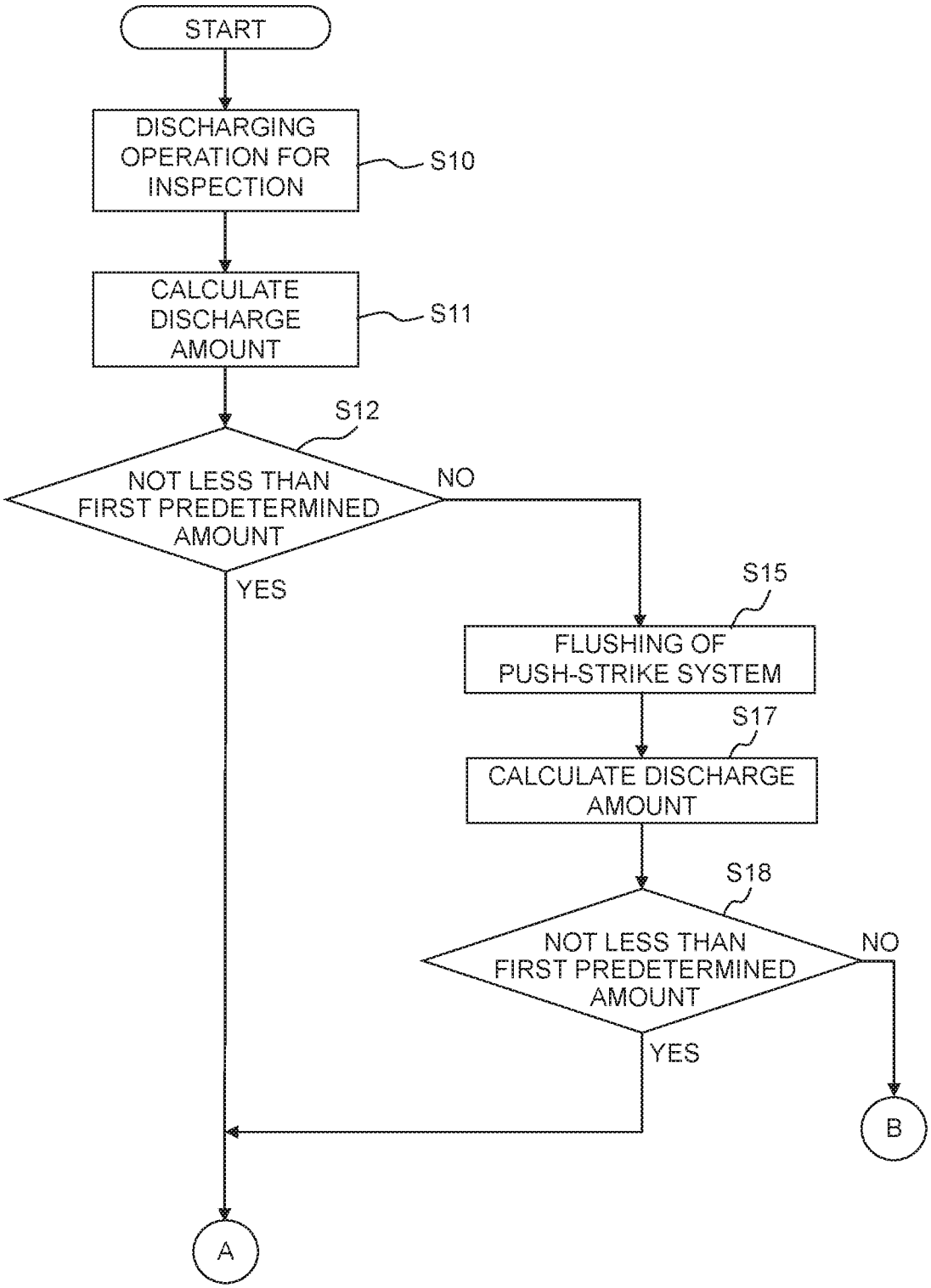
FIGS. 8A and 8B are flow charts depicting an example of a liquid discharge method by a liquid discharge apparatus according to a second embodiment of the present disclosure.
Figure 8B:
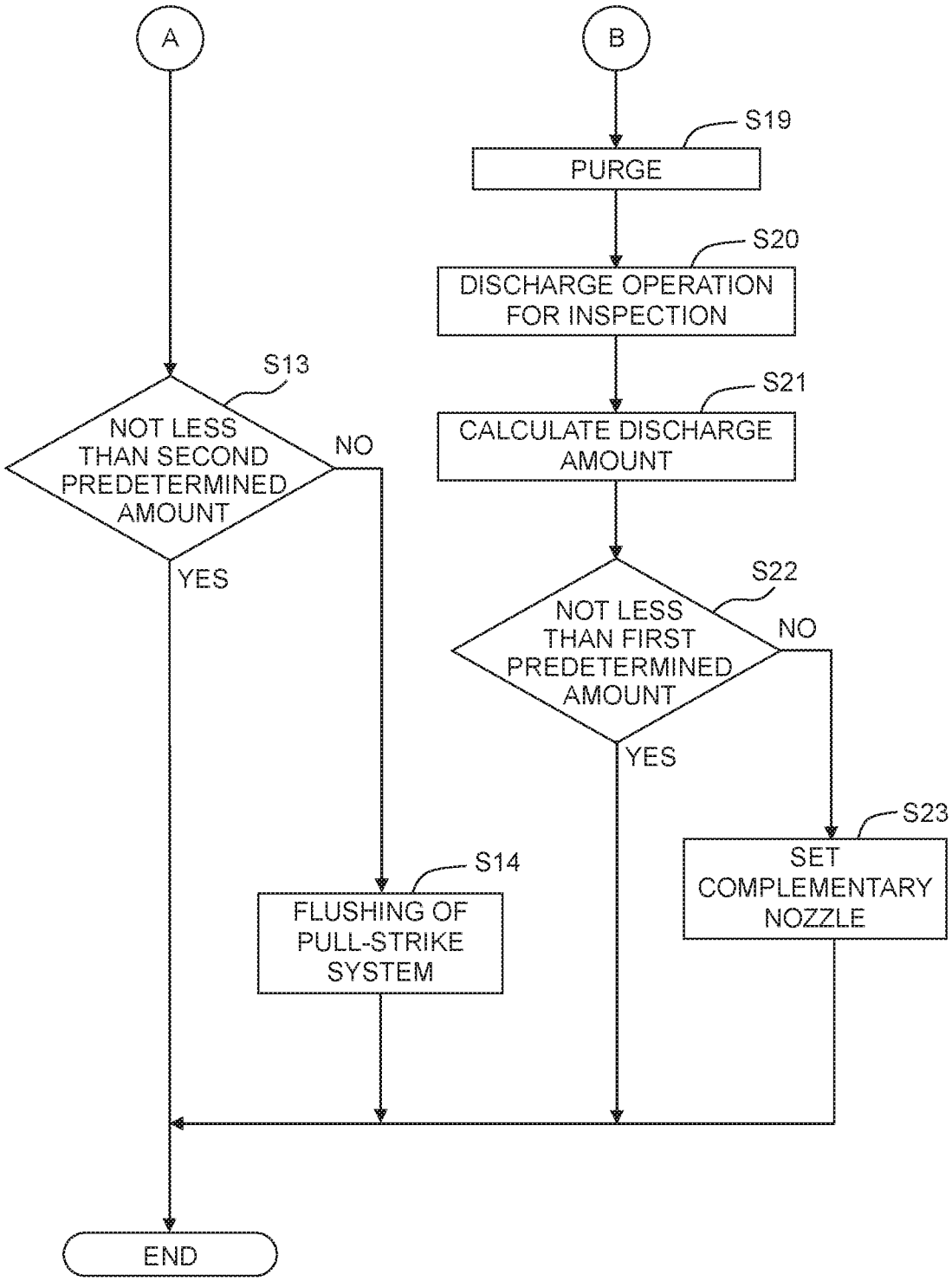

A liquid discharge method according to the second embodiment is performed, for example, by the controlling section 62 executing a computer program for operating the liquid discharge apparatus 10, in accordance with a flow chart depicted in FIGS. 8A and 8B. In the flow chart of FIGS. 8A and 8B, the processing of step S16 of FIG. 6A is omitted. Since the processings of steps S10 to S13 and the processing of steps S17 to S23 of FIGS. 8A and 8B are same as or similar to those of FIGS. 6A and 6B, any explanation therefor will be omitted.

With respect to the non-discharge nozzle 21*c* of which discharge amount is less than the first predetermined amount, the maintenance section 62*c* causes the actuator 30 to perform the flushing of the push-strike system (step S15). In this flushing, the discharging operation is performed by the actuator 30 for a several hundreds of times. With this, in a case that the liquid is discharged from the non-discharge nozzle 21*c*, the liquid is detected by the liquid detecting sensor 73, and the discharge amount calculating section 62*b* calculates a discharge amount (calculated amount) of each of the nozzles 21*c* in accordance with the detection signal from the liquid detecting sensor 73 (step S17). Note that it is allowable that the liquid amount in all the discharging operations in the flushing in step S15 is made to be the discharge amount, or that the liquid amount in a part of the discharging operations is made to be the discharge amount.

According to this manner, the liquid discharged from the non-discharge nozzle 21*c* in the flushing can be used for the detection performed by the discharge detecting section 73*b*. Accordingly, it is not necessary to discharge the liquid separately for the purpose of the detection, and to lower any wasteful consumption of the liquid.

In a similar manner, the maintenance section 62*c* causes the actuator 30 to perform the flushing of the pull-strike system with respect to the unsatisfactory discharge nozzle 21*b* of which discharge amount is less than the second predetermined amount (step S14). In this flushing, several hundreds of times of the flushing are performed by the actuator 30. With this, in a case that the liquid is discharged from the unsatisfactory discharge nozzle 21*b*, the liquid is detected by the liquid detecting sensor 73, and the discharge amount calculating section 62*b* calculates a discharge amount (calculated amount) of each of the nozzles 21*b* in accordance with the detection signal from the liquid detecting sensor 73. In a case that the calculated amount is less than the second predetermined amount, the maintenance section 62*c* executes step S14 again.

OTHER EMBODIMENTS

In all the embodiments described above, although the pull-strike system is used for the discharging system of the discharging operation for inspection, it is allowable to use the push-strike system. With this, since the discharging system of the flushing with respect to the unsatisfactory discharge nozzle 21*b* is made to be different from that in the discharging operation for inspection, it is possible to easily improve the discharge state of the unsatisfactory discharge nozzle 21*b*. Further, in this situation, it is also allowable to change the discharging system of the flushing with respect to the non-discharge nozzle 21*c* to the pull-strike system.

In all the embodiments described above, the suction purge is used, as the purge, in which the liquid is sucked and is forcibly discharged from the nozzle holes 21*h*. Note that, however, the purge is not limited to this, and may be a pressurized purge in which the liquid is pressurized and is forcibly discharged from the nozzle holes 21*h*. In such a case, for example, the pumps 14*e*, 14*f*, which are provided on the sub tank 14*b*, the supply channel 14*c* or the return channel 14*d* apply the pressure to the plurality of nozzles 21 communicating with the manifolds 23 and 24, thereby causing the liquid to be discharged from the plurality of nozzles 21.

In all the embodiments described above, although the return manifold 24 is included in the liquid channel, it is allowable that the return manifold 24 is not included in the liquid channel. In such a case, the supply manifold 23 is provided with the supply port 23*a* and the return port 24*a* on both ends, respectively, in the conveyance direction of the supply manifold 23, and each of the individual channels 11 does not have the return-side throttle channel 22*d*.

Accordingly, the liquid flows from the sub tank 14*b* via the supply channel 14*c* and inflows into the supply manifold 23 via the supply port 23*a*, and branches into the plurality of individual channels 22 while flowing through the supply manifold 23. In each of the individual channels 22, the liquid flows in the supply-side throttle channel 22*a*, the pressure chamber 22*b* and the descender 22*c* in this order, and inflows into the nozzle 21. Further, the liquid which has not flowed into the plurality of individual channels 22 from the supply manifold 23 is discharged (exhausted) from the supply manifold 23 via the return port 24*a*, flows through the return channel 14*d* and returns to the sub tank 14*b*.

In all the embodiments described above, the total amount obtained by totaling the predetermined number of times of the liquid amount (detected amount) detected by the liquid detecting sensor 73 is made to be the discharge amount (calculated amount) of the nozzle 21. In contrast, it is also allowable to plot the detection amounts of the liquid detecting sensor 73 with respect to the time, and to determine the discharge state of the nozzle 21 based on the inclination of the plotted detection amounts. With this, in a case that the discharge state of the nozzle 21 is improved by the discharging operation by the actuator 30, the detection amount (inclination) with respect to the time becomes great (greater). Also based on such a change in the inclination, it is possible to determine the discharge state of the nozzle 21.

Note that all the embodiments as described above may be combined with each other, unless the embodiments are mutually exclusive. For example, it is allowable to further perform the liquid droplet converting processing (flushing amount changing processing) of the first modification in the liquid discharge apparatus 10 of the second embodiment.

Further, a large number of improvements and/or other embodiments of the present disclosure would be apparent, from the above-described explanation, to a person skilled in the art. Accordingly, the above-described explanation should be interpreted as merely exemplary, and as being provided for the purpose of providing, to the person skilled in the art, the best mode for carrying out the present invention. It is possible to substantially change the details of the configurations and/or the functions described above, without departing from the gist and scope of the present invention.

The present disclosure is applicable to the liquid discharge apparatus, the liquid discharge method and the medium storing the program executable by the liquid discharging apparatus which are capable of lowering any wasteful consumption of the liquid.

What is claimed is:

1. A liquid discharge apparatus comprising:

a discharge head including a plurality of nozzles and a plurality of actuators, each of the plurality of actuators being provided corresponding to each of the plurality of nozzles, and being configured to change a volume of a pressure chamber communicating with one of the plurality of nozzles;

a liquid detecting sensor; and a controller configured to:

cause each of the plurality of actuators to perform a discharge operation in which the volume of the pressure chamber is changed so that each of the plurality of nozzles discharges liquid;

calculate a discharge amount of the liquid discharged from each of the plurality of nozzles and detected by the liquid detecting sensor;

determine the discharge amount of the liquid is less than a first predetermined amount, not less than the first predetermined amount and less than a second predetermined amount, or not less than the second predetermined amount, the second predetermined amount being larger than the first predetermined amount; and cause a first actuator of the plurality of actuators corresponding to a first nozzle, whose discharge amount is less than the first predetermined amount, and a second actuator of the plurality of actuators corresponding to a second nozzle, whose discharge amount is not less than the first predetermined amount and less than the second predetermined amount, to perform a flushing in which the volume of the pressure chamber is changed, without causing a third actuator of the plurality of actuators corresponding to a third nozzle, whose discharge amount is not less than the second predetermined amount, to perform the flushing.

2. The liquid discharge apparatus according to claim 1, wherein the flushing is performed in accordance with at least one of a push-strike system and a pull-strike system, the volume of the pressure chamber being reduced from a predetermined volume in the push-strike system and the volume of the pressure chamber being increased from a predetermined volume and then reduced to be not more than the predetermined volume in the pull-strike system.

3. The liquid discharge apparatus according to claim 2, wherein the flushing is performed in accordance with one of the push-strike system and the pull-strike system, and a discharging applied prior to the flushing is the other of the push-strike system and the pull-strike system.

4. The liquid discharge apparatus according to claim 1, wherein the controller is configured to calculate an amount of the liquid discharged from the first nozzle by the flushing.

5. The liquid discharge apparatus according to claim 1, wherein the volume of the pressure chamber is reduced from a predetermined volume in a push-strike system, and wherein the controller is configured to cause the first actuator to perform the flushing of the push-strike system.

6. The liquid discharge apparatus according to claim 1, the liquid discharge apparatus comprising a purge mechanism configured to perform a purge in which the liquid in the discharge head is pressurized or suctioned in a state that openings of the plurality of nozzles are covered by a cap, wherein the controller is configured to calculate a discharge amount of the first nozzle while performing the flushing, and wherein the controller is configured to cause the purge mechanism to perform the purge for the discharge head after the flushing, in a case that the discharge amount of the first nozzle while the flushing is less than the first predetermined amount.

7. The liquid discharge apparatus according to claim 6, wherein the controller is configured to discharge liquid from the first nozzle after the purge, wherein the controller is configured to calculate a discharge amount of the first nozzle after the purge, and wherein the controller is configured to set a complementary nozzle which complements the first nozzle, in a case that the discharge amount of the first nozzle after the purge is less than the first predetermined amount.

8. The liquid discharge apparatus according to claim 1, wherein the volume of the pressure chamber is increased from a predetermined volume and then reduced to be not more than the predetermined volume in a pull-strike system, and wherein the controller is configured to cause the second actuator to perform the flushing of the pull-strike system.

9. The liquid discharge apparatus according to claim 8, wherein the controller is configured to drive the second actuator such that the liquid discharged from the second nozzle in the flushing is as much as an amount based on the calculated discharge amount of the second nozzle.

10. The liquid discharge apparatus according to claim 9, wherein the controller is configured to adjust the amount based on the calculated discharge amount of the second nozzle by adjusting at least one of a number of times of driving the second actuator and a driving pattern of the second actuator.

11. A liquid discharge method using a liquid discharge apparatus, the liquid discharge apparatus comprising a discharge head and a liquid detecting sensor, the discharge head including a plurality of nozzles and a plurality of actuators, each of the plurality of actuators being provided corresponding to each of the plurality of nozzles, and being configured to change a volume of a pressure chamber communicating with one of the plurality of nozzles, the method comprising:

causing each of the plurality of actuators to perform a discharge operation in which the volume of the pressure chamber is changed so that each of the plurality of nozzles discharges liquid;

calculating a discharge amount of the liquid discharged from each of the plurality of nozzles and detected by the liquid detecting sensor;

determining the discharge amount of the liquid is less than a first predetermined amount, not less than the first predetermined amount and less than a second predetermined amount, or not less than the second predetermined amount, the second predetermined amount being larger than the first predetermined amount; and causing a first actuator of the plurality of actuators corresponding to a first nozzle, whose discharge amount is less than the first predetermined amount, and a second actuator of the plurality of actuators corresponding to a second nozzle, whose discharge amount is not less than the first predetermined amount and less than the second predetermined amount, to perform a flushing in which the volume of the pressure chamber is changed, without causing a third actuator of the plurality of actuators corresponding to a third nozzle, whose discharge amount is not less than the second predetermined amount, to perform the flushing.

12. A non-transitory and computer-readable medium storing a program which is executable by a controller of a liquid discharge apparatus, the liquid discharge apparatus comprising:

a discharge head including a plurality of nozzles and a plurality of actuators, each of the plurality of actuators being provided corresponding to each of the plurality of nozzles, and being configured to change a volume of a pressure chamber communicating with one of the plurality of nozzles;

a liquid detecting sensor; and the controller, wherein in a case that the program is executed by the controller of the liquid discharge apparatus, the program causes the controller to function as a maintenance means that:

causes each of the plurality of actuators to perform a discharge operation in which the volume of the pressure chamber is changed so that each of the plurality of nozzles discharges liquid;

calculates a discharge amount of the liquid discharged from each of the plurality of nozzles and detected by the liquid detecting sensor;

determines the discharge amount of the liquid is less than a first predetermined amount, not less than the first predetermined amount and less than a second predetermined amount, or not less than the second predetermined amount, the second predetermined amount being larger than the first predetermined amount; and causes a first actuator of the plurality of actuators corresponding to a first nozzle, whose discharge amount is less than the first predetermined amount, and a second actuator of the plurality of actuators corresponding to a second nozzle, whose discharge amount is not less than the first predetermined amount and less than the second predetermined amount, to perform a flushing in which the volume of the pressure chamber is changed, without causing a third actuator of the plurality of actuators corresponding to a third nozzle, whose discharge amount is not less than the second predetermined amount, to perform the flushing.

* * * * *